United States Patent [19]

Beau et al.

[11] 4,215,530

[45] Aug. 5, 1980

[54] PROCESS AND APPARATUS FOR MANUFACTURING A DRAWN AND TWISTED MULTIFILAMENT SYNTHETIC YARN

[75] Inventors: Patrick Beau, Largentiere; Carlos M. Gabalda, Granges-les-Valence, both of France

[73] Assignee: ASA S.A., Roanne, France

[21] Appl. No.: 2,237

[22] Filed: Jan. 9, 1979

[30] Foreign Application Priority Data

Jan. 13, 1976 [FR] France ..... 78 01437

[51] Int. Cl.[3] ..... D01H 1/10; D01H 7/86; D02J 1/22

[52] U.S. Cl. ..... 57/310; 57/58.49; 57/282

[58] Field of Search ..... 57/58.49, 282, 310, 57/58.72, 58.83, 58.86, 59

[56] References Cited

U.S. PATENT DOCUMENTS

| | | | |
|---|---|---|---|
| 2,979,882 | 4/1961 | Bromley et al. | 57/310 |
| 3,383,850 | 5/1968 | Ratti | 57/282 X |
| 3,525,205 | 8/1970 | Antoni et al. | 57/282 |
| 3,771,307 | 11/1973 | Petrille . | |
| 3,775,961 | 12/1973 | Womer | 57/282 X |

FOREIGN PATENT DOCUMENTS

| | | |
|---|---|---|
| 1262416 | 4/1961 | France . |
| 1500140 | 9/1967 | France . |
| 2052162 | 9/1971 | France . |

*Primary Examiner*—Donald Watkins
*Attorney, Agent, or Firm*—Arnold, White & Durkee

[57] ABSTRACT

In a process and apparatus for manufacturing drawn and twisted multifilament synthetic yarn an extruded and partially drawn filamentary synthetic yarn is subjected to a supplementary, simultaneous, drawing and twisting operation using a double twist spindle rotated such that the tension in the yarn causes drawing. After the spinning and drawing, the yarn is subjected to heat treatment under controlled tension and is then wound up.

10 Claims, 1 Drawing Figure

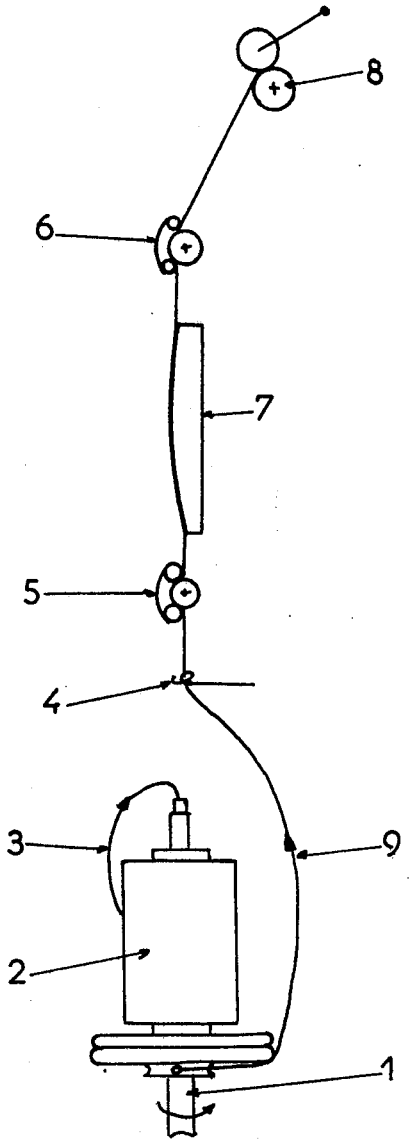
8
6
7
5
4
3
9
2
1

PROCESS AND APPARATUS FOR MANUFACTURING A DRAWN AND TWISTED MULTIFILAMENT SYNTHETIC YARN

The present invention relates to a process and a device for the treatment of partially drawn multifilament synthetic yarns.

In the manufacture of multifilament synthetic yarns, such as nylon or polyester yarns, the principal stages of manufacture are extruding the material, in the molten state or in solution, through a spinneret having a number of holes, then drawing the yarn so as to impart the optimum properties to the filaments, and then subjecting the yarn formed to a throwing or texturising operation.

In general, the yarn is wound up or stored on a support between each of these operations, and this entails numerous handling operations, substantial stockholding and, also, the risk of materials becoming mixed up. Furthermore, such a method of working is expensive and requires the use of separate items of equipment for carrying out the various operations.

In order to reduce the number of operations and to increase productivity it has been proposed to combine the drawing operation either with the extrusion operation or with one of the subsequent treatments, for example the treatments carried out during the texturising operation.

Thus French Pat. No. 1500140 describes a process of obtaining crimped yarn involving vigorously twisting incompletely drawn filaments, and in a second step completing the drawing in the conventional way.

French Pat. No. 2052162 describes interweaving undrawn filaments, with drawing taking place as the final step.

French Pat. No. 1262416 describes the manufacture of a twisted, drawn yarn using a double twist spindle, with the drawing being performed after twisting using two sets of yarn feeders.

Insofar as these techniques allow treatments of yarns which are not totally drawn, they apply to particular types of yarns and/or they do not result in yarn characteristics comparable to those of yarns obtained conventionally by drawing and twisting performed in separate steps.

Furthermore, it has also been proposed partially to draw the yarn during extrusion, the supplementary drawing being carried out during the subsequent operations. The partially drawn yarns are well-known and are usually referred to as partially oriented yarns.

This latter technique is in particular described in U.S. Pat. No. 3771307 which relates to a false twist texturising process in which the feed yarn is a partially drawn polyester yarn, the partial drawing of the filaments being effected by extruding them at a speed of between 2,560 amd 4100 meters per minute.

Hitherto, the partially drawn yarns obtained have principally been used for texturising, and supplementary drawing is carried out during the texturising operation. Surprisingly, hardly any consideration has been given to using these yarns in other sectors of the textile industry, especially directly in a throwing operation, that is to say an operation during which a twist is imparted to the yarn, the amount of twist varying according to the use for which the yarn is intended but being, in the majority of cases, of the order of about a hundred turns per meter.

It has now been found that it is possible to combine the operation of supplementary drawing of the partially drawn and oriented synthetic yarns with a throwing operation which makes it possible to impart a twist to them, provided the process is carried out under precise and specific conditions, and that the yarns produced exhibit properties similar to those obtained in the conventional manner by supplementary drawing and twisting carried out in two separate stages.

According to the present invention there is provided a process for manufacturing a drawn and twisted multifilament synthetic yarn from an extruded and partially drawn filamentary synthetic yarn, the process including the steps of subjecting the yarn to a supplementary drawing and a twisting operation in which drawing and twisting are carried out simultaneously by means of a double twist spindle revolving at a speed such that the tension imparted to the yarn as it passes through the spindle, and especially in the balloon which the yarn forms on leaving the spindle, is such that it causes drawing of the yarn, and wherein, after the simultaneous drawing and twisting, and before winding-up, the yarn is subjected to heat treatment under a controlled tension.

The simultaneous drawing and twisting operation may be carried out with the yarn cold, but it is obvious that it is conceivable to subject the yarn to a direct heat treatment when it is passing through the double twist spindle.

Furthermore, the heat treatment under controlled tension to which the yarn is subjected after the simultaneous drawing and twisting and before winding-up should be effected at a temperature compatible with the nature of the yarn, which temperature is preferably between 70° C. and 240° C. for polyester-based yarns and also between 70° C. and 240 ° C. for polyamide 6,6 yarns. The tension imparted to the yarn during this heat treatment can be such as either to cause slight drawing or, conversely, to cause the yarn to relax.

In general, if additional drawing of the yarn is caused during the supplementary heat treatment, this additional drawing is advantageously effected in a ratio which is between 1:1 and 4:1.

In another aspect, the invention provides a device for use in manufacturing a drawn and twisted multifilament synthetic yarn, the device including a double twist spindle for simultaneously twisting and drawing an extruded partially drawn yarn, two spaced apart feeders to maintain the yarn under controlled tension, a unit located between the feeders for heating the yarn, and a yarn wind-up means downstream of the feeders.

Advantageously, the yarn feeders are feeders of the strap type and the heat treatment unit is a heated plate having a curved surface contacted by the filaments, or a heating means as, for instance, described in U.S. Pat. No. 3,666,008.

Obviously, other types of feeders can be used and instead of the heated plate any other type of heating means can be used.

The invention will be better understood from the following examples, which do not imply any limitation of the scope of the invention. The processes described were carried out on an installation as illustrated in the attached single drawing.

The drawing is a side view of a device according to the invention including a conventional double twist spindle 1, for example a type DDS 260 spindle from Ateliers De Constructions Bourgeas-Fougeirol (SA), 331, Avenue Victor-Hugo, Valence (26) France, on which spindle is mounted a bobbin 2 of partially drawn yarn 3, which is ballooned as at 9 by the spindle. On passing through the double twist spindle, the yarn passes through a guide loop 4 and then through a feeder 5 of the strap type, thereafter close to or in contact with a curved heated plate 7, and then through a second feeder 6, before being wound up at 8. A heating means as in U.S. Pat. No. 3,666,008 can be used in place of the curved heated plate 7.

A series of comparative experiments was carried out on this installation using a partially drawn polyester yarn marketed by DU PONT NEMOURS & CO., the gauge of the yarn before treatment according to the invention, that is to say the gauge of the yarn on the bobbin 2, being 280 decitex, and the yarn comprising 34 strands.

The double twist spindle 1 used was a spindle type DDS 260 from Ateliers De Constructions Bourgeas-Fougeirol (SA), 331, Avenue Victor-Hugo, Valence (26) France and the heater device was of the type of U.S. Pat. No. 3,666,008 and of 500 mm length.

EXAMPLE 1

The conditions under which the yarn was treated were as follows:

| | |
|---|---|
| spped of rotation of the spindle 1 | 8,000 rpm |
| tension of the yarn in the balloon 9 | 170 g |
| temperature of the heater 7 | 220° C. |
| speed of the feeder 5 | 160 m/min |
| speed of the feeder 6 | 160 m/min |
| The yarn obtained exhibited the following properties: | |
| gauge | 168 decitex |
| twist | 100 turns/m |
| strength in grams per decitex | 3.7 |
| elongation in % | 27.5 |

The yarn obtained had a handle and appearance similar to a yarn obtained in the conventional manner by first drawing and then twisting on a double twist spindle.

EXAMPLE 2

The conditions under which the yarn was treated were as follows:

| | |
|---|---|
| speed of rotation of the spindle 1 | 9,000 rpm |
| tension of the yarn in the balloon 9 | 190 g |
| temperature of the oven 7 | 220° C. |
| speed of the feeder 5 | 180 m/min |
| speed of the feeder 6 | 180 m/min |
| The yarn obtained exhibited the following properties: | |
| gauge | 170 decitex |
| twist | 80 turns/m |
| strength in grams per decitex | 3.41 |
| elongation in % | 25.2 |

The yarn obtained had a handle and appearance similar to a yarn obtained in the conventional manner by first drawing and then twisting on a double twist spindle.

EXAMPLE 3

The conditions under which the yarn was treated were as follows:

| | |
|---|---|
| speed of rotation of the spindle 1 | 7,500 rpm |
| tension of the yarn in the balloon 9 | 160 g |
| temperature of the oven 7 | 220° C. |
| speed of the feeder 5 | 150 m/min |

-continued

| | |
|---|---|
| speed of the feeder 6 | 158 m/min |
| drawing ratio | 1.05 |
| The yarn obtained exhibited the following properties: | |
| gauge | 166.22 decitex |
| twist | 100 turns/m |
| strength in grams per decitex | 3.69 |
| elongation in % | 25.5 |

The yarn obtained had a handle and appearance similar to a yarn obtained in the conventional manner by first drawing and then twisting on a double twist spindle.

EXAMPLE 4

By way of comparison, the same yarn was treated under the same conditions, but the speed of the spindle was regulated so that the tension in the balloon did not allow the yarn to be drawn. In this case, the conditions of treatment were as follows:

| | |
|---|---|
| speed of the spindle | 7,000 rpm |
| tension of the yarn in the balloon | 150 g |
| temperature of the oven | 220° C. |
| speed of the feeder 5 | 140 m/min |
| speed of the feeder 6 | 140 m/min |
| final gauge | 264 decitex. |

It was thus found that if the tension of the balloon is reduced, a condition which is in fact always sought when working with a double twist spindle, the yarn is scarcely drawn at all.

EXAMPLE 5

The above Examples 1, 2 and 3 are repeated, except that the yarn was not heat-treated between the two feeders 5 and 6.

The yarns thus obtained are well-drawn and twisted but exhibit a cardboard-like appearance which made them unsuitable for use in weaving, knitting and texturising.

It is thus found that the process according to the invention makes it possible to obtain from partially drawn yarns, drawn and twisted yarns with characteristics compared to conventionally prepared yarns in a simple manner and with reduced capital investment.

I claim:

1. A process for manufacturing a drawn and twisted multifilament synthetic yarn from an extruded and partially drawn filamentary synthetic yarn, the process including the steps of subjecting the yarn to a supplementary drawing and twisting operation in which drawing and twisting are carried out simultaneously by means of a double twist spindle revolving at a speed such that the tension imparted to the yarn as it passes through the spindle, and especially in the balloon which the yarn forms on leaving the spindle, is such that it causes drawing of the yarn, and wherein, after the simultaneous drawing and twisting, and before winding-up, the yarn is subjected to heat treatment under a controlled tension.

2. A process as claimed in claim 1, wherein the yarn is twisted and drawn whilst cold.

3. A process as claimed in claim 1, wherein the yarn is twisted and drawn whilst hot.

4. A process as claimed in claim 1, wherein the heat treatment effected after drawing and twisting and before winding-up is carried out at a temperature of between 70° C. and 240° C.

5. A process for manufacturing a drawn and twisted multifilament synthetic yarn by extruding the yarn through a spinneret, partially drawing the yarn, and subjecting the yarn to a supplementary drawing and twisting operation in which drawing and twisting are carried out simultaneously by means of a double twist spindle revolving at a speed such that the tension imparted to the yarn as it passes through the spindle, and especially in the balloon which the yarn forms on leaving the spindle, is such that it causes drawing of the yarn, and wherein, after the simultaneous drawing and twisting, and before winding-up, the yarn is subjected to heat treatment under a controlled tension.

6. Apparatus for use in manufacturing a drawn and twisted multifilament synthetic yarn from an extruded and partially drawn filamentary synthetic yarn, the device comprising a double twist spindle for simultaneously twisting and drawing the extruded partially drawn yarn, two spaced apart feeders to maintain the yarn under controlled tension, a unit located between the feeders for heating the yarn, and a yarn wind-up means downstream of the feeders.

7. Apparatus as claimed in claim 6, wherein said unit for heating the yarn is a curved heated plate.

8. Apparatus as claimed in claim 6, wherein said two feeders are regulated to run at the same speed.

9. Apparatus as claimed in claim 6, wherein a downstream one of said feeders is regulated to run at a slightly greater speed than that of the other said feeder.

10. Apparatus for manufacturing a drawn and twisted multifilament synthetic yarn, such apparatus comprising a spinneret to extrude the yarn, means to partially draw the yarn, a double twist spindle for simultaneously twisting and drawing the extruded partially drawn yarn, two spaced apart feeders to maintain the yarn under controlled tension, a unit located between the feeders for heating the yarn, and a yarn wind-up means downstream of the feeders.

* * * * *